US006641903B2

(12) United States Patent
Schoela et al.

(10) Patent No.: US 6,641,903 B2
(45) **Date of Patent: *Nov. 4, 2003**

(54) TRANSPARENT PLASTIC PANE OF ACRYLIC GLASS, PROCESS FOR MAKING THE SAME AND USE OF THE SAME

(75) Inventors: Egbert Schoela, Muellendorf (AT); Gerald Molnar, Gramatneusiedl (AT); Mojmir Ruzicka, Vienna (AT)

(73) Assignee: Roehm GmbH & Co. KG, Darmstadt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/474,075

(22) Filed: Dec. 29, 1999

(65) Prior Publication Data

US 2002/0172824 A1 Nov. 21, 2002

(51) Int. Cl.[7] ..... B32B 18/00

(52) U.S. Cl. ..... 428/293.4; 428/297.4; 428/300.1; 52/306; 52/309.1

(58) Field of Search ..... 428/297.4, 293.4, 428/298.1, 299.7, 300.1, 300.7, 298.7; 52/306, 309.1

(56) References Cited

U.S. PATENT DOCUMENTS

| | | | | | |
|---|---|---|---|---|---|
| 2,403,872 | A | * | 7/1946 | Miller | 117/72 |
| 3,383,272 | A | * | 5/1968 | Gluck | 161/44 |
| 4,309,473 | A | * | 1/1982 | Minamisawa et al. | 428/292 |
| 4,443,566 | A | * | 4/1984 | Ying | 428/366 |
| 4,981,754 | A | * | 1/1991 | Hsu | 428/288 |
| 4,997,693 | A | * | 3/1991 | Sonoh et al. | 428/46 |
| 5,040,352 | A | * | 8/1991 | Oberlander et al. | 52/309.1 |
| 5,206,081 | A | * | 4/1993 | Fredrickson | 428/288 |
| 5,372,866 | A | * | 12/1994 | Oberlander et al. | 428/110 |
| 5,432,000 | A | * | 7/1995 | Young et al. | 428/357 |
| 5,612,405 | A | * | 3/1997 | Bainbridge et al. | 524/494 |
| 6,090,478 | A | * | 7/2000 | Nishizaki | 428/297.4 |
| 6,248,204 | B1 | * | 6/2001 | Schuft | 156/305 |
| 6,309,527 | B1 | * | 10/2001 | Broekhuis et al. | 204/501 |

FOREIGN PATENT DOCUMENTS

| | | |
|---|---|---|
| DE | 90 10 087 | 11/1990 |
| DE | 92 12 399 | 5/1993 |
| DE | 43 26 232 | 2/1995 |
| EP | 0 531 982 | 3/1993 |
| EP | 0 769 595 | 4/1997 |

* cited by examiner

*Primary Examiner*—Marie Yamnitzky
*Assistant Examiner*—J. M. Gray
(74) *Attorney, Agent, or Firm*—Oblon, Spivak, McClelland, Maier & Neustadt, P.C.

(57) ABSTRACT

A transparent plastic pane of acrylic glass with internal plastic filaments, which largely hold together the fragments formed in the event of a break characterized in that the plastic filaments are at least partly sized. The internal filaments can be sized completely and/or partly, for example in portions. Hereby the matrix adhesion of the filaments can be adjusted to the effect that any fragments which may be formed in the event of break are largely held together by the filaments without permitting undesired detachment of the filaments during thermal stresses in the normal range of −20 to 120° C. The plastic panes are suitable in particular as a noise protection wall.

12 Claims, No Drawings

TRANSPARENT PLASTIC PANE OF ACRYLIC GLASS, PROCESS FOR MAKING THE SAME AND USE OF THE SAME

The present invention relates to transparent plastic panes of acrylic glass with internal plastic filaments, which largely hold together fragments formed in the event of a break, to a process for making such transparent plastic panes and to the use of the said plastic panes. In particular, the invention relates to transparent plastic panes which in the event of break of the plastic pane essentially do not produce any splinters or loose fragments, the panes of such type being suitable in particular for noise protection walls.

Noise protection walls with transparent plastic panes are known, for example, from European Patent EP 0407852. The plastic panes disclosed therein very successfully perform their function of preventing formation and falling of loose fragments. Stripes, ornaments or figures to ward off birds can additionally be embedded in the plastic panes described in the cited European Patent.

European Patent EP 0531982 also discloses transparent plastic panes with internal plastic filaments, which largely hold together fragments formed in the event of a break, the panes disclosed in the cited European Patent being provided with embedded filaments that are contrast-rich and thus can also act as particularly esthetic protection against birds.

Although the noise protection elements according to the prior art can excellently perform their function, which is to prevent release of splinters or fragments in the event of an automobile accident, crash or similar incident, it has been found during the use of such plates in practice that the inherently excellently homogeneous optical impression of the transparent plastic pane with internal filaments can be distorted off and on by a glitter or sheen. This can be due at least in part to detachment of the embedded plastic filaments from the PMMA matrix of the acrylic glass pane. Filament detachment at points or even over entire portions certainly does not substantially jeopardize the retention of fragments upon destruction of the noise protection wall, but total reflection of light in the PMMA channels along the detached portions causes just such glitter or sheen that can adversely influence the esthetic impression.

It is merely possible to speculate about the cause of the filament detachment that may occur from time to time. Conceivably it could relate to different coefficients of linear thermal expansion of the plastic material of filament and matrix of the acrylic glass pane in the relevant temperature range of about −20 to 120° C. For example, the dependence upon temperature of the coefficient of linear thermal expansion of the filament material is greater in the case of polyamide than the dependence on temperature of the coefficient of thermal expansion of PMMA. This means that one of the materials contracts at a relevant temperature, while the other material expands. Under certain circumstances, such behavior of the materials can promote detachment of the embedded filaments from the matrix.

In view of the cited and discussed prior art, the object of the present invention was to provide a transparent plastic pane of acrylic glass with internal filaments of plastic which, during continuous use under normal conditions, such as use as a noise protection wall, imparts an excellent homogeneous optical impression.

Another object of the invention was to provide such a plate in which the optical impression is not distorted by sheen or glitter even in prolonged use and after numerous temperature cycles.

Yet another object of the invention was to provide a corresponding pane or plate in which the optical impression is not distorted but which at the same time has the excellent positive properties of the known plates, especially the absence of excessive adhesion to the surrounding acrylic glass, so that in the event of breakage of the acrylic glass the filaments retain their ability to stretch, with the result that they do not break and therefore hold the fragments together.

As regards the method, the object of the present invention was to find a simply and favorably achievable method which permits the manufacture of transparent plastic panes of acrylic glass with internal plastic filaments, the adhesion of the embedded filaments to the matrix being sufficiently great that any fragments which may be formed in the event of breakage of the pane are secured without permitting undesired detachment of the filaments during continuous use under normal load, for example as a noise protection wall.

Finally, another object of the invention was to specify the use of transparent plastic panes of acrylic glass according to the invention.

The cited objects as well as other objects that are not specifically mentioned individually but are clearly evident from the introduction are achieved by a transparent plastic pane of the type mentioned in the introduction and comprising:

internal plastic filaments which hold together fragments of said acrylic glass formed in the event of a break;

wherein said plastic filaments are sized over a length of about 2 to 10 cm at intervals of from about 0.5 to 1.5 m with a solution comprising a) a sizing agent which comprises ≦ 10% of phenol; ≦ 2% of formaldehyde; ≦ 2% of methanol; and ≦ 30% of ethanol and b) p-toluenesulfonic acid in ethanol.

Preferred embodiments are the subject matter of the dependent claims referring back to the independent claims.

The method for making a transparent plastic pane of acrylic glass, provides a solution to the problems underlying the invention. Expedient modifications of the method are the subject matter of the claims dependent on the independent method claim. The method for making a transparent plastic pane of acrylic glass comprises:

sizing plastic filaments over a length of about 2 to 10 cm at intervals of about 0.5 to 1.5 m, to obtain sized plastic filaments;

embedding said sized plastic filaments in said acrylic glass to obtain internal plastic filaments;

wherein said plastic filaments are sized with a solution comprising a) a sizing agent which comprises ≦ 10% of phenol; ≦ 2% of formaldehyde; ≦ 25 of methanol; and ≦ 30% of ethanol and b) p-toluenesulfonic acid in ethanol;

wherein said internal plastic filaments hold together fragments of said acrylic glass formed in the event of a break.

It was a surprising discovery, which could not have been easily foreseen, that unpleasant glitter or sheen in a transparent plastic pane of acrylic glass with internal filaments of plastic, which hold together the fragments formed in the event of a break, can be prevented, without adversely influencing the splinter-retaining function of the embedded filaments, by sizing the plastic filaments at least partly. For the first time, therefore, it is possible with the invention to achieve an esthetically pleasing and optically satisfactory form of noise protection elements of acrylic glass which does not exhibit any detrimental optical properties even in continuous use and during normal temperature cycles of day and night.

The transparent plastic panes of acrylic glass according to the invention are known in themselves to the person skilled in the art. Pane thicknesses are typically 4 to 40 mm and preferably 12 to 25 mm. The panes are normally made with measurements of 1.5 m×1 m to 2 m×3 m, but larger or smaller measurements are also possible for special applications.

The panes are usually extensively transparent and preferably colorless or lightly tinted in colors such as smoke-brown. The colorless, transparent plastic panes usually have a transmittance of at least 70%, although a transmittance of 90 to 95% is advantageous. Tinted models usually have a transmittance of 45 to 75%, usually between 50 and 60%.

The embedded plastic filaments are usually made of a plastic which is incompatible with the polymer matrix of the acrylic glass pane. For example, polyamide filaments or polypropylene filaments are suitable. Single-strand filaments, or in other words monofilaments are preferred. Usually the filaments run horizontally in the plastic pane, since the panes are laterally clamped; the cohesion in the event of a break is then particularly favorable. As a rule, the filaments are laid parallel to one another. If desired or necessary, two layers of filaments, running in two directions, can be disposed in the pane, an angle of 90° between filaments of different layers being advantageous. Such a design has the outward appearance of a cross-woven fabric.

Of course, it is also possible to embed the filaments in such a way that at least one of the embedded filaments has a maximum deflection of 1 mm or more from an imaginary straight line through the ends of the filament. The somewhat sagging positioning of the plastic filaments in the acrylic glass matrix leads under certain circumstances to more advantageous behavior of the plates suitable as a noise protection wall in the relevant tests, which are known to the person skilled in the art from the corresponding standards.

The plates according to the invention are characterized in that the embedded plastic filaments are at least partly sized. This means either that all plastic filaments can be completely sized, or else that only some of the plastic filaments embedded in a plate are sized and, in fact, only partly.

In a particularly preferred embodiment, the plastic pane according to the invention is characterized in that the internally embedded plastic filaments are completely sized.

Alternatively, it can also be expedient for the internal filaments to be sized in portions. In other words, a filament is sized over a specified length of about 2 to 10 cm at specified intervals, which preferably are equal to 0.5 to 1.5 m and especially preferably about 1 m. With this AB system of partly sized filaments, it is possible to vary the matrix adhesion of the embedded filaments such that it is optimal for the surrounding acrylic glass matrix and is matched to all ordinary requirements. With an AB system of a partly sized filament, for example, the main part of the filament, or in other words the major portion of the length of a filament can remain loose in the PMMA matrix. As a result, the functioning principle in particular is assured, while nevertheless the filament can be optimally fixed at the sized locations by the described procedure. Detachment of the filament due to normal temperature cycles during the day and night is therefore prevented.

Sized filaments are coated at least over parts of their surface with the residues of a sizing agent. In principle, any size known to the person skilled in the art and containing suitable sizing agents can be used. In a particularly advantageous embodiment, the plastic pane according to the invention is characterized in that the filaments are coated with the residues of a sizing agent containing a dissolved phenol-formaldehyde resin. It has been shown in the scope of the invention that such a dissolved formaldehyde resin permits particularly favorable concentration ranges for the size treatment, simultaneously accompanied by great variability in adjustment of the matrix adhesion of the sized filaments.

Also belonging to the invention is a method for manufacture of a transparent plastic pane of acrylic glass with internal plastic filaments, which largely hold together fragments produced in the event of a break, in which method the plastic filaments are embedded in the acrylic glass, the method being characterized in that the filaments are sized before they are embedded.

Detachment of filaments from the matrix may contribute causally to the sheen or glitter of the filaments, but can be avoided by a size treatment. As already mentioned, in principle all agents familiar to the person skilled in the art for this purpose can be used as sizing agents. Especially preferable are sizing agents that contain dissolved phenol-formaldehyde resin.

In a particularly advantageous modification of the method according to the invention, the filaments are treated, before being embedded in the acrylic glass matrix, with a sizing agent having approximately the following composition:

| | |
|---|---|
| phenol | ≦10% |
| formaldehyde | ≦2% |
| methanol | ≦2% |
| ethanol | ≦30% |

The phenol-formaldehyde mixture is reacted with para-toluenesulfonic acid under acid-catalyzed conditions and then brought appropriately into contact with the filaments to be sized.

In the process, and as already mentioned, the filaments may either be contacted completely with the size, in other words over their entire length, or in portions therewith. After the filaments have been treated with the size, they are dried and then embedded in the acrylic glass matrix by standard techniques.

The adhesion of the sized filaments to the matrix can be influenced in various ways. Firstly, the type of size can be varied. Secondly, the concentration of sizing agent in the size can also be adjusted during the sizing treatment in order to vary the adhesion to the matrix. Finally, the filaments to be embedded can be contacted completely or partly along their length with the size. Moreover, it is permissible to embed completely sized filaments or partly sized filaments, or in other words filaments sized in portions, together with unsized filaments in one and the same plastic pane.

In a particularly favorable phenol-formaldehyde resin size, it has been found that a certain concentration range is particularly favorable for the size treatment. If the size concentration is too high, matrix adhesion of the filament may become too great, with the consequence that unsecured fragments can be formed during destructive tests of the transparent plastic panes according to the invention containing embedded plastic filaments. When the acrylic glass plates are broken, the polyamide filaments can snap, since elongation is prevented by the excessive adhesion. One example of how this problem of size concentration (matrix adhesion) can be overcome while nevertheless guaranteeing the advantages of fixation of the plastic filament in the plate is to use the AB system already mentioned hereinabove. In a particularly favorable modification of the method according to the invention, the plastic filaments are treated with size over lengths of 2 to 10 cm at intervals of 0.5 to 1.5 m before being embedded in the matrix and so, after the filaments pretreated in this way have been embedded, the main body of the filament remains loose in the PMMA matrix, while the functioning principle, or in other words fixation of the filament, is nevertheless achieved.

It is also particularly expedient to adjust the concentration of the size such that the matrix adhesion of the filament is sufficiently strong that fragments produced in the event of break are largely held together, without the occurrence of filament detachment during thermal stresses in the range from −20° C. to 120° C.

Finally, the use of the described panes for a noise protection wall also belongs to the invention.

The invention will be explained in more detail by means of the following examples:

Example 1

There are prepared

Solution 1

4.940 g ethanol and 60 g Araldite® K6 (trade name of Ciba-Geigy) for a sizing agent with the composition

| | |
|---|---|
| phenol | ≦10% |
| formaldehyde | ≦2% |
| methanol | ≦2% |
| ethanol | ≦30% |

Solution 2

4.991 g ethanol and 9 g para-toluenesulfonic acid (PTSA).

The two solutions are mixed just before use, and a monofilament polyamide filament is pulled through this mixture then into a drying section. The dried filament is then used for manufacture of acrylic glass panes by the chamber method.

During breaking tests on the plate manufactured in this way, it was noted that unsecured fragments were formed at an Araldite® concentration of higher than 0.6% (relative to the total of solutions 1 and 2). When Araldite® concentrations of 50.4% were used, complete filament adhesion was no longer assured.

It was also found that no sheen or glitter, or in other words no filament detachment occurred during a large number of day-and-night cycles in the temperature range from −20 to 120° C. The optical impression of the plate was excellently homogeneous and constant in time.

Example 2

The same procedure was used as in Example 1, the only difference being that the filament was impregnated for a length of 5 cm every 80 cm. The size concentration in this case also was 0.6%. This alternative embodiment is advantageous because there is no risk of excessive size application, fixation of the filament in the PMMA matrix is assured, and the filament is nevertheless mobile, so that in this case also no unsecured fragments were formed in the destructive test.

Example 3

As in practical example 2, but only the coated parts of the polyamide filament are disposed along the rims of the acrylic glass plate. This has the advantage that, in the event of possible destruction, the fixed parts of the polyamide plate are not impacted and thus further improvement of the functioning principle of the acrylic glass plates is achieved.

What is claimed is:

1. A transparent plastic pane of acrylic glass, comprising:

internal plastic filaments which hold together fragments of said acrylic glass formed in the event of a break;

wherein said plastic filaments are sized over a length of about 2 to 10 cm at intervals of from about 0.5 to 1.5 m with a solution comprising a) a sizing agent which comprises ≦10% of phenol; ≦2% of formaldehyde; ≦2% of methanol; and 30% of ethanol and b) p-toluenesulfonic acid in ethanol.

2. A plastic pane according to claim 1, wherein the filaments are monofilaments selected from the group consisting of polyamide, polypropylene, and mixtures thereof.

3. A plastic pane according to claim 1, wherein the internal embedded plastic filaments are fully encased in the acrylic glass.

4. A plastic pane according to claim 1, wherein the plastic filaments are disposed along the rim of the acrylic glass pane.

5. The transparent plastic pane according to claim 1, wherein a transmittance is at least 70%.

6. The transparent plastic pane according to claim 1, wherein a transmittance is 90 to 95%.

7. A noise protection wall comprising the transparent plastic panes of acrylic glass claimed in claim 1.

8. A transparent plastic pane of acrylic glass, consisting of:

acrylic glass and sized plastic filaments which hold together fragments of said acrylic glass formed in the event of a break;

wherein said plastic filaments are sized over a length of about 2 to 10 cm at intervals of about 0.5 to 1.5 m with a solution comprising a) a sizing agent which comprises 10% of phenol; ≦2% of formaldehyde; ≦2% of methanol; and ≦30% of ethanol and b) p-toluenesulfonic acid in ethanol.

9. A method for making a transparent plastic pane of acrylic glass, comprising:

sizing plastic filaments over a length of about 2 to 10 cm at intervals of about 0.5 to 1.5 m, to obtain sized plastic filaments;

embedding said sized plastic filaments in said acrylic glass to obtain internal plastic filaments;

wherein said plastic filaments are sized with a solution comprising a) a sizing agent which comprises ≦10% of phenol; ≦2% of formaldehyde; ≦2% of methanol; and ≦30% of ethanol and b) p-toluenesulfonic acid in ethanol;

wherein said internal plastic filaments hold together fragments of said acrylic glass formed in the event of a break.

10. A method according to claim 9, wherein the concentration of the size is adjusted such that the matrix adhesion of the filament holds together fragments of said acrylic glass produced in the event of break, without the occurrence of filament detachment during thermal stresses between −20° C. and 120° C.

11. The method according to claim 9, wherein the filaments are sized by pulling said filaments through a sizing solution containing from 0.4 to 0.6% by weight of a size; and then drying said filaments.

12. A noise protection wall comprising transparent plastic panes of acrylic glass obtained by the method of claim 9.

* * * * *